US005235704A

United States Patent [19]

Collins

[11] Patent Number: 5,235,704

[45] Date of Patent: Aug. 17, 1993

[54] NECKTIE APPARATUS

[76] Inventor: Robert C. Collins, 165 Camden Ct., Vallejo, Calif. 94591

[21] Appl. No.: 860,549

[22] Filed: Mar. 30, 1992

[51] Int. Cl.[5] ..... A41D 25/02; A41D 25/04

[52] U.S. Cl. ..... 2/155; 2/156; 2/145; 24/49 R; 24/50; 24/312

[58] Field of Search ..... 2/145, 149, 150, 155, 2/156, 310, 311, 312, 338, 340; 24/49 R, 50, 176, 312, 313

[56] References Cited

U.S. PATENT DOCUMENTS

| | | | |
|---|---|---|---|
| 1,704,422 | 3/1929 | Belunes | 2/155 X |
| 1,712,734 | 5/1929 | Kraemer | 24/313 |
| 1,720,009 | 7/1929 | Sherman | 2/155 X |
| 1,724,769 | 8/1929 | Nikolopoulos | 2/155 X |
| 1,764,044 | 6/1930 | Hoffman | 24/313 X |
| 1,881,677 | 10/1932 | Klinetob | 2/155 |
| 2,667,677 | 2/1954 | Ganz | 24/176 |
| 2,834,967 | 5/1958 | Taksa | 2/155 |
| 3,579,641 | 5/1971 | Larson | 24/176 |
| 5,003,636 | 4/1991 | Marostica | 2/145 |

FOREIGN PATENT DOCUMENTS

| | | | |
|---|---|---|---|
| 847849 | 10/1939 | France | 24/176 |
| 1089231 | 3/1955 | France | 24/176 |

*Primary Examiner*—Clifford D. Crowder
*Assistant Examiner*—Jeanette E. Chapman

[57] ABSTRACT

Necktie apparatus including a first necktie segment and a second necktie segment. A connector element is connected to each of the necktie segments for releasably attaching the necktie segments. The segments will disconnect automatically when a force of sufficient magnitude is applied to the tie, thus protecting the wearer from injury. The lengths of the front panels of each elongated necktie segment may be readily adjusted.

3 Claims, 2 Drawing Sheets

NECKTIE APPARATUS

TECHNICAL FIELD

This invention relates to necktie apparatus for wear by individuals. More particularly, the necktie apparatus of the invention includes a safety feature; namely, a quick disconnect feature wherein two necktie segments may readily be separated from one another when desired. Also, the necktie apparatus permits ready adjustment of the length of the necktie.

BACKGROUND ART

Every wearer of a necktie faces a common problem; namely, the fact that the length of the necktie may be inappropriate for the size of the wearer. Also, the person tieing the necktie often has to repeat this task in order to assure that the necktie panels are properly positioned both with respect to each other and with respect to the wearer's body.

Conventional neckties are of unitary construction and this accounts for the difficulties noted above. In addition, neckties of unitary construction can be dangerous to the wearer. If the necktie is caught in machinery or otherwise subjected to strong pulling forces, the wearer can be injured or even killed.

Most neckties are tied by the wearer prior to use; however, neckties are known in the prior art which are of the pre-tied type. That is, the knot is already formed and the necktie is clipped onto the shirt of the wearer or otherwise secured thereto. These arrangements have their own drawbacks. Most do not have the "natural" look of a conventional tie which has been knotted by the wearer. Also, there is no way to adjust the positioning of the tie panels relative to the wearer. This means that pre-tied ties are often either too short or too long.

DISCLOSURE OF INVENTION

The present invention relates to necktie apparatus which is of inexpensive, relatively simple construction. With this necktie apparatus, the length of the tie can be readily adjusted, as may the relative positioning of the two front panels of the tie. Furthermore, the tie apparatus includes two necktie segments which may readily be selectively connected together or disconnected, thus eliminating the hazards common to conventional neckties.

The necktie apparatus includes a first necktie segment formed of flexible material and a second necktie segment formed of flexible material.

Attachment means is provided for releasably attaching the necktie segments. The attachment means includes a first connector element connected to the first necktie segment and a second connector element connected to the second necktie segment. The first and second connector elements each include latch means for selectively latching and delatching the connector elements.

In the embodiment disclosed herein, the necktie segments are elongated. The first elongated necktie segment is adjustable relative to the first connector element and the second elongated necktie segment is adjustable relative to the second connector element.

The first elongated necktie segment includes a first front panel and the second elongated necktie segment includes a second front panel. The front panels are positionable at the front of a wearer of the necktie. Adjustment of the first elongated necktie segment relative to the first connector element varies the length of the first front panel and adjustment of the second elongated necktie segment relative to the second connector element varies the length of the second front panel.

Other features, advantages, and objects of the present invention will become apparent with reference to the following description and accompanying drawings.

BEST MODE FOR CARRYING OUT THE INVENTION

Figure 1:
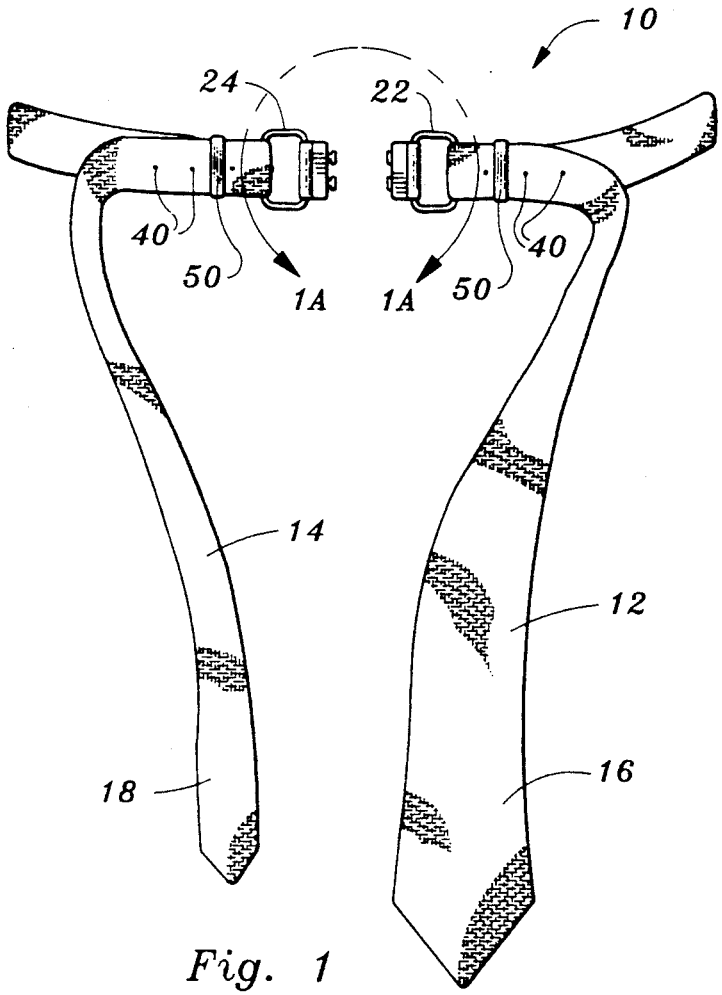
FIG. 1 is a frontal view of a preferred form of necktie apparatus constructed in accordance with the teachings of the present invention and showing the two necktie segments separated from one another.
Figure 1A:
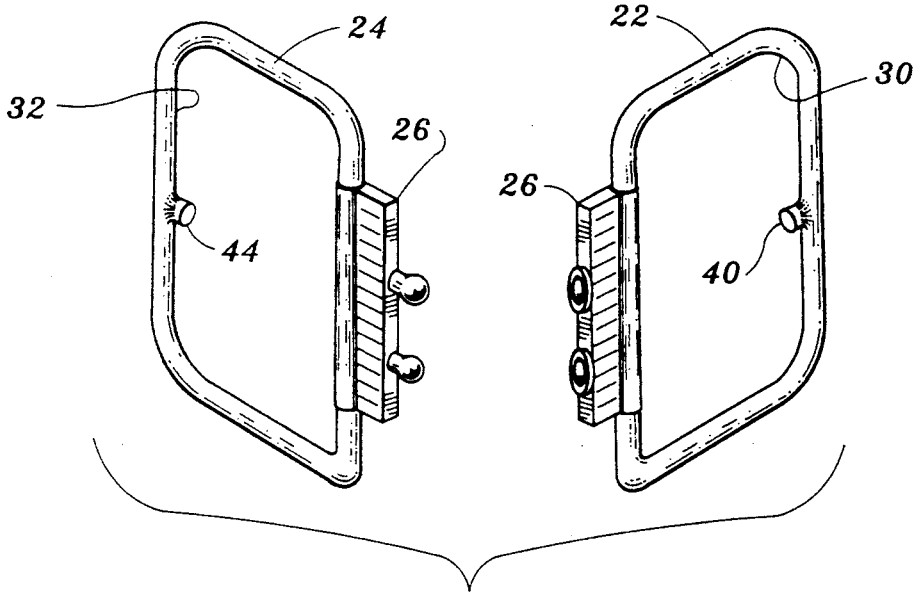
FIG. 1A is an enlarged, perspective view of attachment means for releasably attaching the necktie segments.

Referring now to the drawings, necktie apparatus constructed in accordance with the teachings of the present invention is generally designated by reference numeral 10. The apparatus includes a first elongated necktie segment 12 and a second elongated necktie segment 14. Segments 12, 14 are formed of cloth or other suitable type of flexible material.

Segment 12 includes a first front panel 16 and second segment 14 includes a second front panel 18, the front panels being positionable at the front of a wearer of the necktie. FIG. 1 illustrates these front panels 16, 18 positioned at the front of a wearer with the necktie apparatus in untied condition.

Attachment means is provided for releasably attaching the necktie segments. More particularly, the attachment means includes a first connector element in the form of a buckle component 22 and a second connector element in the form of a buckle component 24. When the necktie apparatus is worn, these connector elements are normally disposed out of sight under the collar at the back of a wearer's neck.

Buckle component 22 includes the female or receptacle portion 26 of a snap fastener of any desired conventional type. The buckle component 24 includes the male component 28 of such snap fastener. That is, the connector elements in the form of the buckle components can readily be snapped together and unsnapped at the will of the wearer to provide selective separation of the connector elements as well as of the necktie segments which are connected thereto.

Buckle component 22 defines an aperture 30 which provides for the passage of first elongated necktie segment 12 therethrough, as shown in FIG. 1. Likewise, buckle component 24 defines an aperture 32 which accommodates second elongated necktie segment 14.

Each of the elongated necktie segments may be adjusted relative to its associated connector element. Along portions of the lengths thereof the necktie segments define a plurality of openings 40. To position the necktie segments at the desired locations relative to the connector elements or buckle components, a selected aperture 40 on each of the necktie segments is brought into registry with a projection 44 formed on the associated connector element. The projections hold the necktie segments in place relative to the connector element or buckle components when bights are formed in the necktie segments and the necktie segments are doubled back upon themselves as shown in FIG. 1. If desired, a slidable loop member 50 may be employed in operative association with each of the necktie segments in order to maintain the bight configuration.

Thus, it will be seen that the lengths of the front panels of the tie apparatus may be readily adjusted by selecting the apertures 40 which are to accommodate the projections 44.

Figure 2:
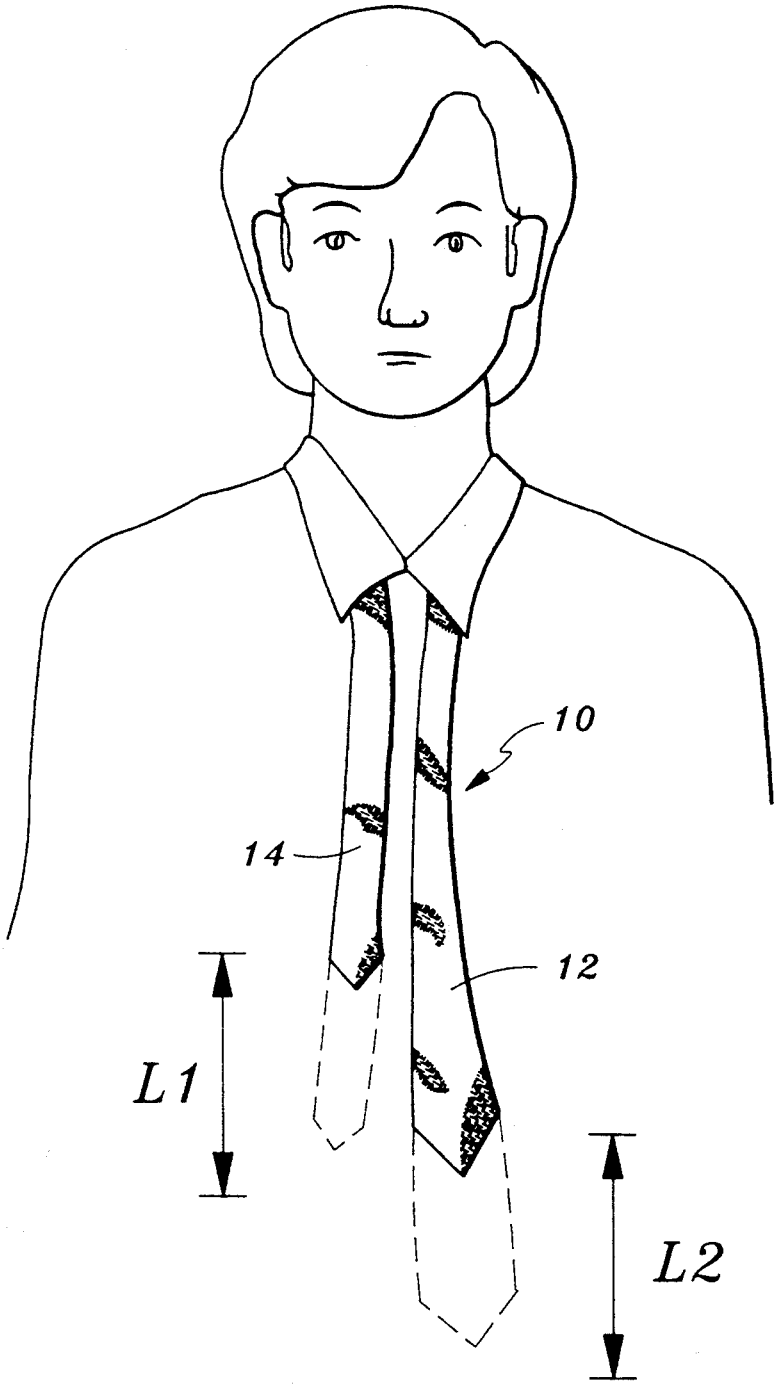
FIG. 2 is a somewhat diagrammatic, frontal view illustrating the necktie apparatus of the present invention being worn by an individual.

As shown in FIG. 2, the lengths of the front panels may readily be modified over the distances L1 and L2. Once proper adjustment is made, the necktie segments may be knotted by the wearer in any suitable conventional fashion.

If undue stress is exerted on the necktie segments, as by exerting a sharp pull thereon, the buckle components will separate from one another and the entire necktie apparatus will be removed from about the wearer's neck. This is an important safety feature. Wearers of conventional neckties can be injured or even killed if the ties are caught in machinery or otherwise subjected to sharp or severe pulling forces.

It should be appreciated that the principles of the present invention may be applied to types of neckties other than that specifically disclosed, for example, bow or string ties.

I claim:

1. Necktie apparatus comprising, in combination:

a first elongated necktie segment formed of flexible material and partially positionable at the front of a wearer of said necktie apparatus;

a second elongated necktie segment non-integral with said first elongated necktie segment formed of flexible material and partially positionable at the front of a wearer of said necktie apparatus; and quick disconnect attachment means for releasably attaching said elongated necktie segments to each other and for readily detaching said elongated necktie segments from each other, said attachment means including a first connector element adjustably connected to said first elongated necktie segment for varying the length of said first elongated necktie segment and a second connector element adjustably connected to said second elongated necktie segment for varying the length of said second elongated necktie segment; each of said connector elements is a buckle component defining an aperture; each of said necktie segments passing through the aperture of the buckle component to which the necktie segment is attached and forming a bight; each of said necktie segments defines a plurality of openings; each said buckle component including a projection selectively positionable in said openings; said first and second connector elements each including latch means for selectively latching said connector elements whereby said first and second elongated necktie segments are attached and for delatching said connector elements upon application of opposed pulling forces on said first and second connector elements to detach said first and second elongated necktie segments from each other, and said attachment means cooperable with said elongated necktie segments to facilitate adjustability in the lengths of said elongated necktie segments and to maintain said adjusted elongated necktie lengths during wearing of said necktie apparatus.

2. The necktie apparatus according to claim 1 wherein said necktie segments are elongated, said first elongated necktie segment including a first front panel and said second elongated necktie segment including a second front panel, said front panels positionable at the front of a wearer of said necktie, adjustment of said first elongated necktie segment relative to the first connector element by varying the length of said first front panel and adjustment of said second elongated necktie segment relative to the second connector element by varying the length of said second front panel.

3. The necktie apparatus according to claim 1 wherein said latch means comprises snap fasteners.

* * * * *